US006449447B1

(12) United States Patent
Regelsberger et al.

(10) Patent No.: US 6,449,447 B1
(45) Date of Patent: Sep. 10, 2002

(54) IMAGE-FORMING MACHINE HAVING CHARGER CLEANING ACTIVATION AFTER AN ARCING FAULT AND RELATED METHOD

(75) Inventors: Matthias H. Regelsberger; James A. Zimmer, Jr.; George R. Walgrove, all of Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/629,389

(22) Filed: Aug. 1, 2000

(51) Int. Cl.[7] ..... G03G 15/02
(52) U.S. Cl. ..... 399/100; 361/230
(58) Field of Search ..... 399/100, 99, 11, 399/48, 170, 171, 127, 128; 361/213, 225, 229, 230; 250/324–326

(56) References Cited

U.S. PATENT DOCUMENTS

| | | | | |
|---|---|---|---|---|
| 4,680,669 A | | 7/1987 | Tsuchiya et al. | |
| 4,777,554 A | * | 10/1988 | Gokita | |
| 4,928,149 A | | 5/1990 | Harmon | |
| 5,089,848 A | * | 2/1992 | Kusuda et al. | 399/100 X |
| 5,194,897 A | | 3/1993 | Yoshiyama et al. | |
| 5,392,099 A | * | 2/1995 | Kusumoto et al. | 250/325 X |
| 5,485,255 A | | 1/1996 | Reuschle et al. | |
| 5,809,364 A | | 9/1998 | Tombs et al. | |
| 6,134,095 A | | 10/2000 | May et al. | |

FOREIGN PATENT DOCUMENTS

| | | |
|---|---|---|
| JP | 1-261676 | * 10/1989 |
| JP | 9-90717 | * 4/1997 |

* cited by examiner

*Primary Examiner*—Susan S. Y. Lee

(57) ABSTRACT

The present invention provides an electrophotographic (EP) image-forming machine and related method having activation of a charger cleaner in a corona charger after an arcing fault. The corona charger has corona wires connected to a high voltage potential supply, preferably providing a voltage in the range of about 5 to 11 kva or in the range of about 13,000 to 22,000 volts peak-to-peak. A corona voltage detection circuit is connected to measure current changes in the high voltage potential supply. A grid has a preselected electric potential to control the charge. The grid may be grounded, but preferably is connected to a power supply providing a voltage in the range of about 300 to 900 volts. A grid voltage detection circuit is connected to measure current changes in the power supply. The voltage detection circuits provide a voltage signal to a microprocessor. When arcing occurs, the microprocessor cycles the EP image-forming machine into a standby mode. The charger cleaning apparatus is activated to clean the charger. When the cleaning is completed, the EP image-forming machine returns to normal operation. In a further aspect of the present invention, the image-forming process stops when arcing occurs. The charger is cleaned. Any prints affected by the arcing are disposed. The image-forming process restarts at the image frame where the arc occurred.

20 Claims, 4 Drawing Sheets

IMAGE-FORMING MACHINE HAVING CHARGER CLEANING ACTIVATION AFTER AN ARCING FAULT AND RELATED METHOD

FIELD OF THE INVENTION

This invention relates generally to image-forming machines and methods having charger cleaners. More particularly, this invention relates to electrophotographic image-forming machines and methods having activation of a charger cleaner for a corona charger following an arcing fault.

BACKGROUND OF THE INVENTION

Electrophotographic (EP) image-forming machines are used to transfer images onto paper or other medium. Generally, a photoconductor is selectively charged and optically exposed to form an electrostatic latent image on the surface. Toner is deposited onto the photoconductor surface. The toner is charged, thus adhering to the photoconductor surface in areas corresponding to the electrostatic latent image. The toner image is transferred to the paper or other medium. The paper is heated for the toner to fuse to the paper. The photoconductor is then refreshed—cleaned to remove any residual toner and charge—to make it ready for another image.

EP image-forming machines use chargers for various applications in the image-forming process. In general, sensitizing chargers are used to form the electrostatic latent image on the surface of the photoconductor. Transfer chargers are used to transfer the toner image from the photoconductor to the paper or other medium. Separation chargers are used to separate the paper from the photoconductor.

These chargers have various configurations. However, they share a similar design, namely that of a corona charger. In a corona charger, discharge or corona wires are positioned within a housing. There is at least one corona wire, but usually three or four. A high voltage potential source is connected to the corona wires to generate ions for charging a surface such as a photoconductor. The high voltage source may be direct current (DC) or alternating current (AC) and provides very low current. For DC, the voltage potential of the corona wires is typically in the range of 5 to 11 kva. For AC, the voltage potential is typically in the range of 13,000 to 22,000 volts peak-to-peak.

Many chargers have a grid—a mesh of perpendicular crossing wires—positioned between the corona wires and the surface to be charged. The grid has an electrical potential or is grounded to control the charging from the corona wires. The electrical potential of the grid is typically in the range of 300 to 900 volts.

The high voltage potential of the corona wires naturally attracts toner, dust, and other particles. These particles build up and contaminate the corona wires and the grid. This contamination causes poor image quality in the reproduced images and may eventually cause the corona wires and grid to no longer be a uniform charging mechanism.

In addition, the particles and contamination can trigger arcing. While most arcing is from the corona wires to the grid, arcing may occur from the corona wires to the housing and to the photoconductor. The arcing effectively disrupts the charging field, thus causing artifacts to appear on the print images. The artifacts include streaks, spots, speckles, and others.

Many EP image-forming machines have a charger cleaner for cleaning the corona wires and/or grid. Some designs vibrate the corona wires, essentially shaking the contamination loose. Other designs pass a cleaning pad over the corona wires and/or between the corona wires and the grid.

Most charger cleaning is done during the power-up and/or self-check cycles of the EP image-forming machine. Additional charger cleaning is done at preselected intervals, usually after certain quantities of prints are made. However, the amount of toner used differs from print to print. Also, environmental factors may affect the rate of build-up and the level of contamination. Some designs clean the charger after a certain amount of toner is used. Other designs attempt to avoid arcing by sensing when conditions favor arcing and then changing the operating conditions of the EP image-forming machine.

These designs are preventative in nature. However, arcing eventually does happen. When arcing does occur, the high voltage potential supply in most designs detects the arc and reports it to the controller of the EP image-forming machine. Depending upon the specific charger causing the arc, a log error is generated or the machine is shutdown. Normal machine operation is reestablished without action regarding the fault. If the source of the arcing has not been removed, additional arcing may occur. If repeated arcing occurs, the controller eventually will lock out the machine and request service.

Generally, an arc is due to contamination of the corona wires. Consequently, an arc, in most cases, indicates the charger needs cleaning. Also, the output image produced from the image frame where the arcing occurred is usually of very poor quality. This poor quality image should be identified and replaced.

Accordingly, there is a need for an electrophotographic image-forming machine that cleans the corona charger after arcing occurs and replaces the poor quality image created by the arcing.

BRIEF SUMMARY OF THE INVENTION

The present invention provides an electrophotographic (EP) image-forming machine and related method having activation of a corona charger cleaner after arcing occurs. The image-forming process stops when arcing occurs. The corona charger is cleaned. Any prints affected by the arcing are disposed. The image-forming process restarts at the image frame where the arc occurred.

In one aspect of the present invention, an EP image-forming machine has a photoconductor operatively mounted on support rollers. A primary charger, an exposure machine, a toning station, a transfer charger, a fusing station, and a cleaner are operatively disposed about the photoconductor. The EP image-forming machine also has a separation charger, a densitometer, microprocessor control, and other features.

At least one of the primary charger, the transfer charger, and the separation charger has a corona charger with a charger cleaning apparatus. The corona charger also has corona wires disposed within a housing, which is made from an insulative material such as a resin or the like. The corona charger may have any number of corona wires. Preferably, the corona charger has three corona wires.

The corona wires connect to a high voltage potential supply, which may be direct current (DC) or alternating current (AC). In DC, the high voltage supply preferably provides a voltage in the range of about 5 to 11 kva. In AC, the high voltage supply provides a voltage in the range of about 13,000 to 22,000 volts peak-to-peak.

The voltage potential in the corona wires creates a charging field for charging a surface, which may be the photoconductor or other medium for electrostatic charging. A corona voltage detection circuit is connected to measure current changes in the high voltage potential supply. The corona voltage detection circuit provides a voltage signal to a microprocessor.

A grid positioned to cover the open end of the housing. The grid is disposed adjacent to the surface and has a preselected electric potential to control the charge laid down on the surface. The grid may be grounded, but preferably is connected to a power supply providing a voltage in the range of about 300 to 900 volts. A grid voltage detection circuit is connected to measure current changes in the power supply. The grid voltage detection circuit provides a voltage signal to the microprocessor The microprocessor is connected to the corona cleaning apparatus. The corona cleaning apparatus may be any commercially available corona cleaner, an adaptation thereof, and other suitable designs for cleaning the corona charger. Preferably, the corona cleaning apparatus is a pad or the like disposed to pass between and clean the corona wires and the grid.

The microprocessor or other control device monitors fluctuations in the current supplied to the corona wires and the grid. When arcing occurs, the currents of the high voltage potential supply and/or the power supply fluctuate. The corona voltage detection circuit and the grid voltage detection circuit measure the current fluctuations and provide corresponding voltage signals to the microprocessor.

When a voltage signal is received, the microprocessor cycles the EP image-forming machine into a stand-by mode. The microprocessor may have a buffer or other storage to hold the voltage signal until it can be addressed by the microprocessor. The charger cleaning apparatus is activated to clean the charger; namely, the corona wires and the grid. When the cleaning is completed, the EP image-forming machine returns to normal operation.

In another aspect of the present invention, the EP image-forming machine address the poor quality of the image made on the image frame where the arcing occurred. While the EP image-forming machine is in standby mode, the microprocessor or other control unit determines the faulty image frame—the image frame where the arcing occurred.

The poor image quality print due to the faulty image frame, and preferably, all the image prints that follow the faulty image frame are removed or otherwise disposed. The machine restarts the EP process at the image frame where the arcing occurred.

The following drawings and description set forth additional advantages and benefits of the invention. More advantages and benefits are obvious from the description and may be learned by practice of the invention.

BRIEF DESCRIPTION OF SEVERAL VIEWS OF THE DRAWINGS

The present invention may be better understood when read in connection with the accompanying drawings, of which.

DETAILED DESCRIPTION OF THE INVENTION

Figure 1:
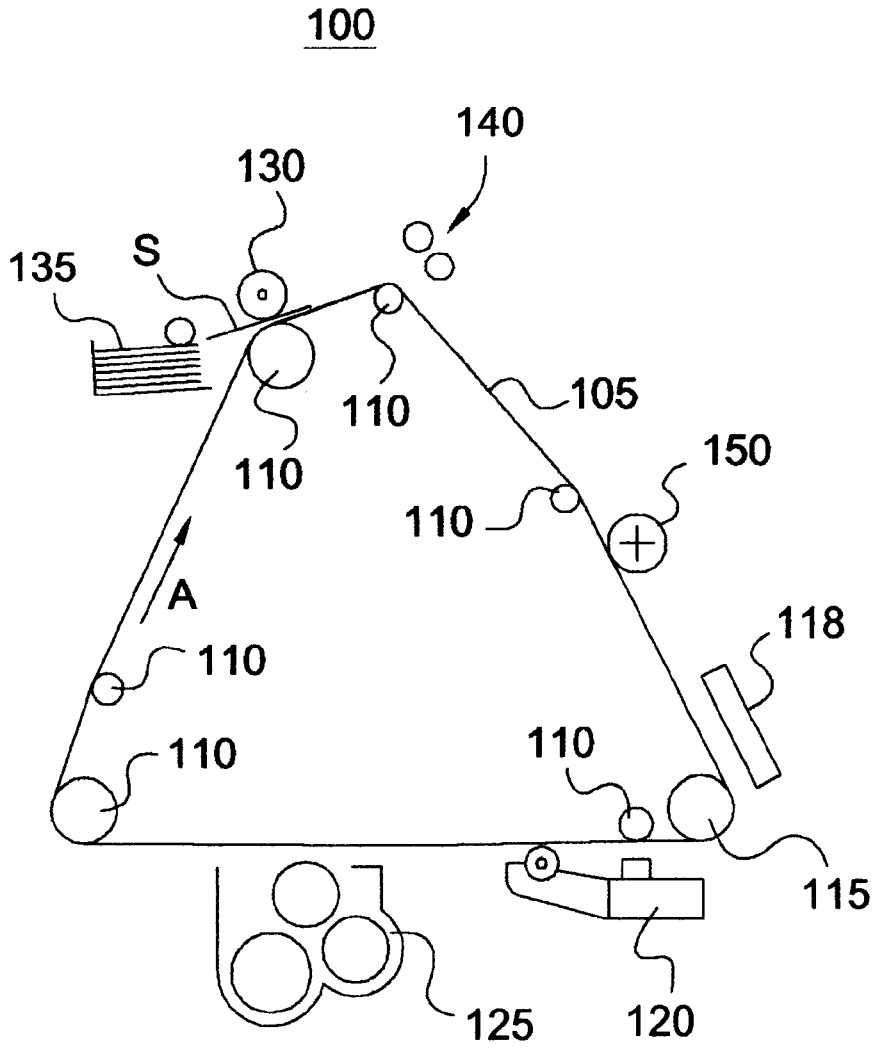
FIG. 1 shows a block diagram of an electrophotographic image-forming machine having activation of a charger cleaner after an arcing fault according to an embodiment of the present invention.

FIG. 1 shows a block diagram of an electrophotographic (EP) image-forming machine 100 having charger cleaning activation after an arc fault according to an embodiment of the present invention. A photoconductor 105 is operatively mounted on support rollers 110. A motor 115 moves the photoconductor 105 in the direction indicated by arrow A. A primary charger 118, an exposure machine 120, a toning station 125, a transfer charger 130, a fusing station 140, and a cleaner 150 are operatively disposed about the photoconductor 105. While not shown, the EP image-forming machine 100 has a separation charger (which may be incorporated with the transfer charger 130), a densitometer, microprocessor control, and other features.

Figure 2:
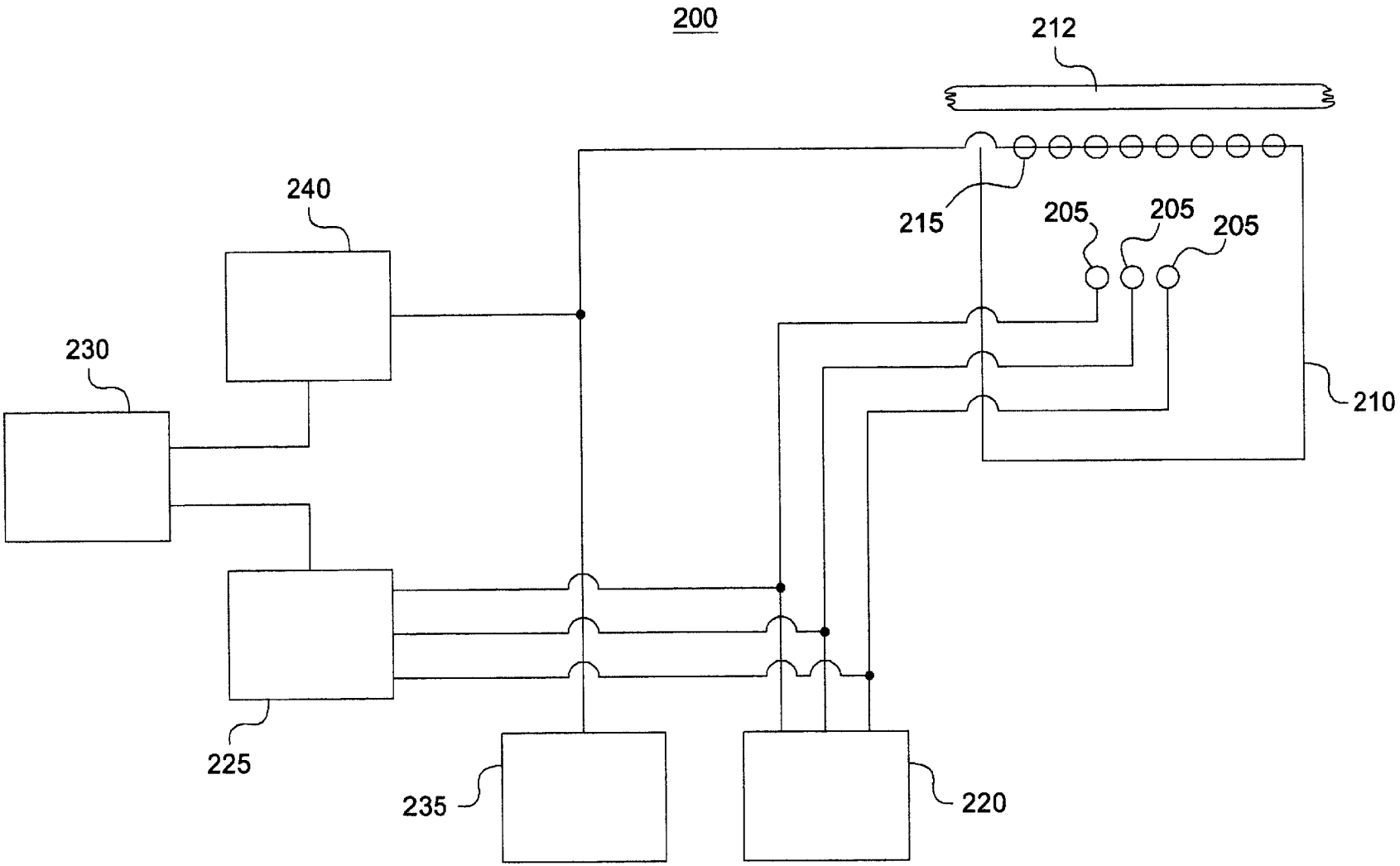
FIG. 2 shows a block diagram of corona charger having activation of a charger cleaner after an arcing fault according to an embodiment of the present invention.

FIG. 2 shows a block diagram of a corona charger 200 having activation of a charger cleaner after an arcing fault according to an embodiment of the present invention. The corona charger 200 is at least one of the primary charger 118, the transfer charger 130, and the separation charger. The corona charger may be any of the other chargers used in the EP process.

The corona charger 200 has corona wires 205 disposed within a housing 210. Although not shown, the corona wires 205 are anchored in the housing 210, which is made from an insulative material such as a resin or the like. Three corona wires are illustrated. However, the corona charger 200 may have any number of corona wires including as few as one. Preferably, the corona charger has three corona wires 205.

The corona wires 205 connect to a high voltage potential supply 220, which may be direct current (DC) or alternating current (AC). In DC, the high voltage potential supply preferably provides a voltage in the range of about 5 to 11 kva. In AC, the high voltage supply provides a voltage in the range of about 13,000 to 22,000 volts peak-to-peak.

The voltage potential in the corona wires 205 creates a charging field for charging a surface 212, which may be the photoconductor 105 or other medium for electrostatic charging. A corona voltage detection circuit 225 is connected to the high voltage potential supply 220. While the corona voltage detection circuit 225 preferably measures current changes in the high voltage potential supply 220, the corona voltage detection circuit 225 may use other voltage detection means. The corona voltage detection circuit 225 may be part of the high voltage potential supply 220. The corona voltage detection circuit 225 provides a voltage signal to the microprocessor 230.

The housing 210 forms a U-shape, having a grid 215 positioned to cover the open end of the housing 210. The grid 205 is disposed adjacent to the surface 212 and has a preselected electric potential to control the charge laid down on the surface 212. While the grid 205 is described and illustrated, the present invention may be used with corona chargers not having a grid.

The grid 215 connects to a power supply 235, preferably providing a voltage in the range of about 300 to 900 volts. Alternatively, the grid 215 may be grounded. A grid voltage detection circuit 240 is connected to the power supply 235. While the grid voltage detection circuit 240 preferably measures current changes in the power supply 235, the grid voltage detection circuit 240 may use other voltage detection means. The grid voltage detection circuit 240 may be part of the power supply 235. The grid voltage detection circuit 240 provides a voltage signal to the microprocessor 230.

Particular voltage detection circuits are described. However, the corona and grid voltage detection circuit circuits 225, 240 may be any electrically sensitive device, including a voltage detector, capable of measuring the electrical changes associated with arcing and providing a signal of those changes to the microprocessor 230.

The microprocessor 230 may be the main microprocessor for controlling the EP image-forming machine 100. The microprocessor 230 also may be a sub-microprocessor to the main microprocessor or otherwise connected to other microprocessors. The microprocessor 230 is connected to the exposure machine 120 in order to provide instructions and/or information regarding the faulty image frame where the arcing occurred.

The microprocessor 230 is connected to a corona cleaning apparatus (not shown). The corona cleaning apparatus may be any commercially available corona cleaner, an adaptation thereof, and other suitable designs for cleaning the corona charger 200. Preferably, the corona cleaning apparatus is a pad or the like disposed to pass between and clean the corona wires 205 and the grid 215. The corona cleaning apparatus may be set to clean the corona charger 200 during the warm-up and self-test cycles of the EP image-forming machine. The corona cleaning apparatus also may be set to clean the corona charger 200 at preset intervals including the number of prints produced and the amount of toner used.

The corona voltage detection circuit 225 monitors fluctuations in the current supplied to the corona wires 205. Similarly, the grid voltage detection circuit 240 monitors fluctuations in the current supplied to the grid 215. Other voltage detection circuits may be used to monitor other components such as the housing 210.

When arcing occurs, the currents of the high voltage potential supply 220 and/or the power supply 235 fluctuate. The corona voltage detection circuit 225 and the grid voltage detection circuit 240 measure the current fluctuations and provide voltage signals to the microprocessor 230. The voltage signals correspond to current fluctuations in either or both of the supplies 220, 235.

The microprocessor 230 receives the voltage signal(s) in an interrupt mode or a multitask mode. In the interrupt mode, a voltage signal from either or both of the voltage detection circuits 225, 240 interrupts whatever operation the microprocessor 230 is performing. The microprocessor begins immediately to address the voltage signal. In the multitask mode, the microprocessor 230 sequentially progresses through varies tasks, one of them checking for the voltage signals from the voltage detection circuits 225, 240 at the appropriate time. Accordingly, the microprocessor 230 addresses the voltage signal during the time to check the voltage signals. The microprocessor 230 or the voltage detection circuits 225, 240 may have a buffer or other storage to hold the voltage signal until it can be addressed by the microprocessor 230. The interrupt mode also may have a buffer or other storage so the voltage signal is not lost. The buffer avoids the appearance of double arcs to the microprocessor 230.

When a voltage signal is received, the microprocessor 230 cycles the EP image-forming machine into a standby mode. The charger cleaning apparatus is activated to clean the charger; namely, the corona wires 205 and the grid 215. When the cleaning is completed, the EP image-forming machine returns to normal operation.

In another aspect of the present invention, the EP image-forming machine address the poor quality of the image made on the image frame where the arcing occurred. While the EP image-forming machine is in standby mode, the microprocessor 230 or other control unit determines the faulty image frame—the image frame where the arcing occurred.

The poor image quality print due to the faulty image frame is removed or otherwise disposed from the EP image-forming machine. Preferably, all the image prints that follow the faulty image frame are removed or otherwise disposed. The EP image-forming machine may dispose of the poor image prints into an unused discharge bin in the machine. If no unused discharge bin is available, the machine does not restart automatically, but signals the operator to remove the poor image prints.

Once the poor quality image prints are removed, the machine may start normal operation. However, the machine does not start at the most recent image frame. Rather, the machine cycles through until it is at the faulty image frame. Thus, the machine restarts the EP process at the image frame where the arcing occurred.

Figure 3:
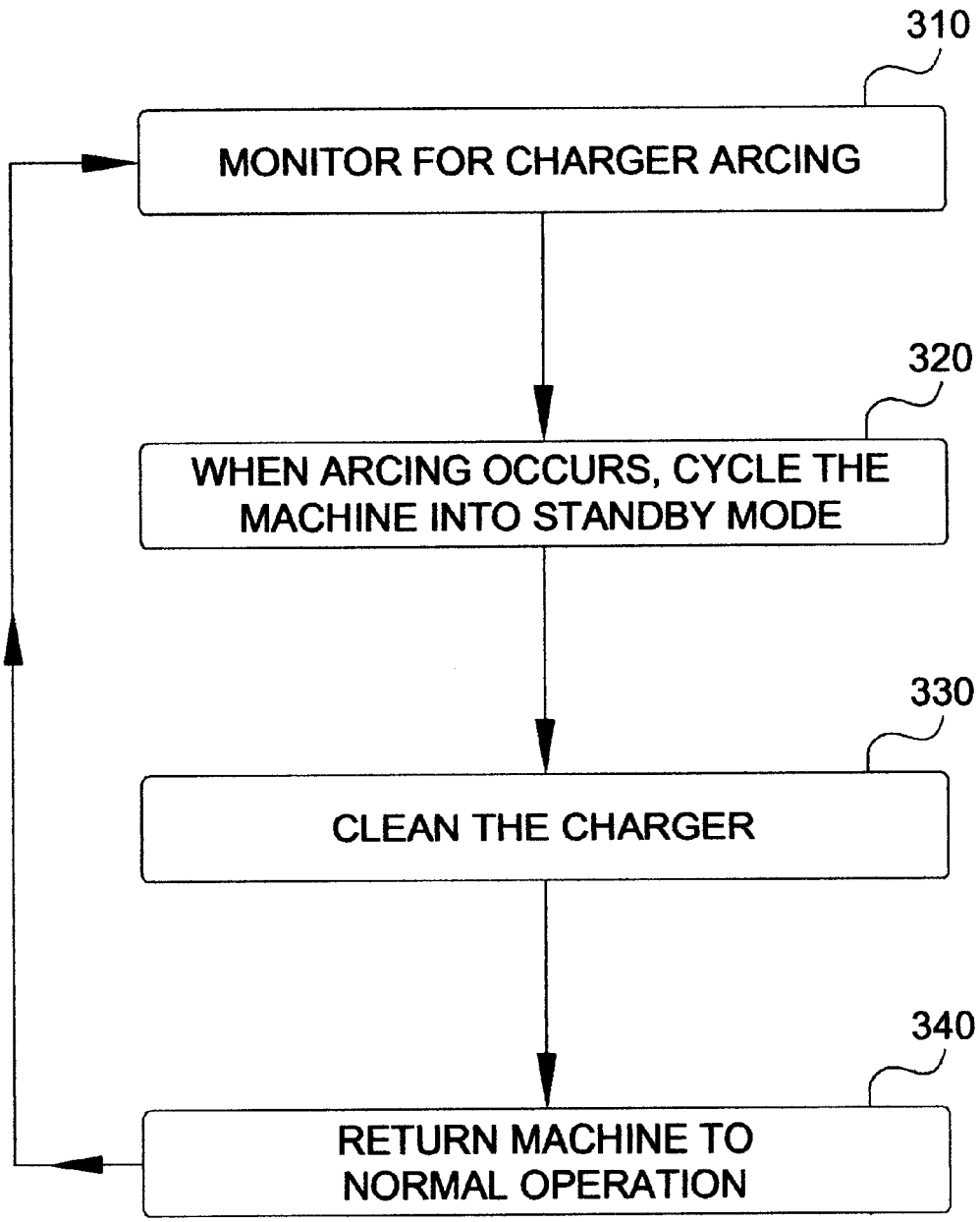
FIG. 3 shows a block diagram of a method for activation of a corona cleaner in a corona charger after an arcing fault according to an embodiment of the present invention.

FIG. 3 shows a flowchart of a method for activation of a charger cleaner in a corona charger of an EP image-forming machine according to an embodiment of the present invention.

In Step 310, a corona charger is monitored for arcing. The corona charger could be any of the corona chargers in an EP image-forming machine including the primary or sensitizing charger, the transfer charger, and the separation charger. Voltage detection circuits are connected to the power supplies for the corona wires and grid. The voltage detection circuits provide a voltage signal to a microprocessor. The voltage signal indicates when arcing occurs.

In Step 320, when the voltage detection circuits indicate arcing has occurred in the corona charger, the microprocessor cycles the machine into standby mode. In standby mode, generally all activities cease.

In Step 330, the microprocessor activates the charger cleaner, which may be any of the commercially available charger cleaners. Preferably the charger cleaner has a pad for passing between the corona wires and grid.

In Step 340, the EP image-forming machine returns to normal operation. When the charger cleaning is complete, the EP image-forming machine continues to Step 310.

Figure 4:
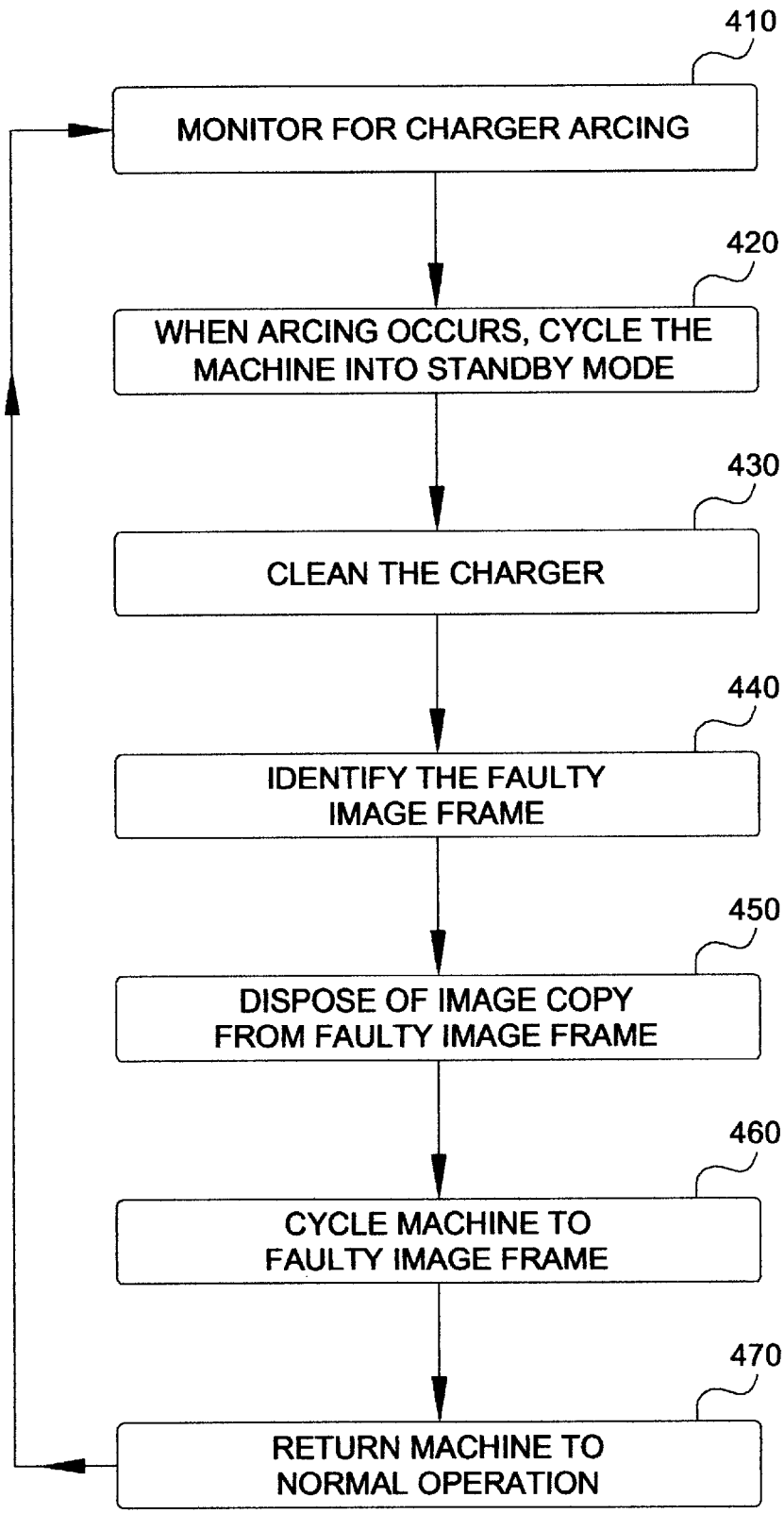
FIG. 4 shows a block diagram of an alternate method for activation of a corona cleaner in a corona charger after an arcing fault according to an embodiment of the present invention.

FIG. 4 shows a flowchart of an alternate method for post-arc charger cleaning activation in an EP image-forming machine according to an embodiment of the present invention.

In Step 410, a corona charger is monitored for arcing. The corona charger could be any of the corona chargers in an EP image-forming machine including the primary or sensitizing charger, the transfer charger, and the separation charger. Voltage detection circuits are connected to the power supplies for the corona wires and grid. The voltage detection circuits provide a voltage signal to a microprocessor. The voltage signals indicate when arcing occurs.

In Step 420, when the voltage detection circuits indicate arcing has occurred in the corona charger, the microprocessor cycles the machine into standby mode. In standby mode, generally all activities cease.

In Step 430, the microprocessor activates the charger cleaner, which may be any of the commercially available charger cleaners. Preferably the charger cleaner has a pad for passing between the corona wires and grid.

In Step 440, the microprocessor or other control unit identifies the faulty image frame, the frame where the arcing occurred. The faulty image frame generally returns to normal once the photoconductor is refreshed. However, the image print produced when the arcing occurred is presumed to have poor image quality—it should be disposed and remade.

In Step 450, the poor image print due to the faulty image frame is disposed or otherwise removed from the machine. If the machine has an unused discharge bin, the poor image print is cycled into the unused discharge bin. Preferably all the image prints in process and following the faulty image frame are cycled into the unused discharge bin. If no discharge bin is available, the machine cycles to standby mode and the operator is alerted to remove the poor image and following image prints in progress.

In Step 460, the machine is cycled to restart at the faulty image frame. In this manner, the interrupted image-forming job may be restarted at the appropriate position to replace the image from the faulty image frame.

In Step 470, the EP image-forming machine returns to normal operation. The EP image-forming machine continues to Step 410.

While the invention has been described and illustrated, this description is by way of example only. Additional advantages will occur readily to those skilled in the art, who may make numerous changes without departing from the true spirit and scope of the invention. Therefore, the invention is not limited to the specific details, representative machines, and illustrated examples in this description. Accordingly, the scope of this invention is to be limited only as necessitated by the accompanying claims.

What is claimed is:

1. An image-forming machine having charger cleaning activation after an arcing fault, comprising:

a photoconductor having a surface;

at least one charger operatively disposed adjacent to the photoconductor, the at least one charger having a charger cleaning apparatus; and an exposure machine operatively disposed adjacent to the photoconductor, the exposure machine to optically expose and form a latent electrostatic image on the surface, wherein the at least one charger comprises, at least one corona wire disposed to provide a charging field to the surface, a voltage potential supply connected to the at least one of a corona wire, a corona voltage detection circuit connected to the voltage potential supply, the corona voltage detection circuit to provide a corona voltage signal in response to arcing of the at least one corona wire, and a control device connected to receive the corona voltage signal, the control device to activate the charger cleaning apparatus in response to the corona voltage signal.

2. An image-forming machine according to claim 1, wherein the at least one charger further comprises:

a grid operatively disposed adjacent to the at least one corona wire;

a power supply connected to the grid; and a grid voltage detection circuit connected to the power supply, the grid voltage detection circuit to provide a grid voltage signal in response to arcing of the grid, wherein the control device is connected to receive the grid voltage signal, the control device to activate the charger cleaning apparatus in response to the grid voltage signal.

3. An image-forming machine according to claim 2, wherein the power supply provides a voltage in the range of about 300 volts to 900 volts.

4. An image-forming machine according to claim 1, wherein the voltage potential supply provides one of a first voltage and a second voltage, the first voltage in the range of about 5 to 11 kva and the second voltage in the range of about 13,000 to 22,000 volts peak-to-peak.

5. An image-forming machine according to claim 2, wherein the charger cleaning apparatus has a pad to pass between the at least one corona wire and the grid.

6. An image-forming machine having charger cleaning activation after an arcing fault, comprising:

a photoconductor having a surface;

at least one charger operatively disposed adjacent to the photoconductor, the at least one charger having a charger cleaning apparatus; and an exposure machine operatively disposed adjacent to the photoconductor, the exposure machine to optically expose and form a latent electrostatic image on the surface, wherein the at least one charger comprises, at least one corona wire disposed to provide a charging field to the surface, a voltage potential supply connected to the at least one of a corona wire, a corona voltage detection circuit connected to the voltage potential supply, the corona voltage detection circuit to provide a corona voltage signal in response to arcing of the at least one corona wire, a grid operatively disposed adjacent to the at least one corona wire, a power supply connected to the grid, a grid voltage detection circuit connected to the power supply, the grid voltage detection circuit to provide a grid voltage signal in response to arcing of the grid, a control device connected to receive the corona voltage signal and the grid voltage signal, the control device to activate the charger cleaning apparatus in response to at least one of the corona voltage signal and the grid voltage signal.

7. An image-forming machine according to claim 6, wherein the voltage potential supply provides one of a first voltage and a second voltage, the first voltage in the range of about 5 to 11 kva and the second voltage in the range of about 13,000 to 22,000 volts peak-to-peak, and wherein the power supply provides a voltage in the range of about 300 volts to 900 volts.

8. An image-forming machine according to claim 6, wherein the charger cleaning apparatus has a pad to pass between the at least one corona wire and the grid.

9. A corona charger having charger cleaning activation after an arcing fault, the corona charger for electrostatically charging a surface in an image-forming machine, comprising:

at least one corona wire disposed to provide a charging field to the surface;

a charger cleaning apparatus disposed to clean the at least one corona wire;

a voltage potential supply connected to the at least one of a corona wire;

a corona voltage detection circuit connected to the voltage potential supply, the corona voltage detection circuit to provide a corona voltage signal in response to arcing of the at least one corona wire; and a control device connected to receive the corona voltage signal, the control device to activate the charger cleaning apparatus in response to the corona voltage signal.

10. A corona charger according to claim 9, further comprising:

a grid operatively disposed adjacent to the at least one corona wire;

a power supply connected to the grid; and a grid voltage detection circuit connected to the power supply, the grid voltage detection circuit to provide a grid voltage signal in response to arcing of the grid, wherein the control device is connected to receive the grid voltage signal, the control device to activate the charger cleaning apparatus in response to the grid voltage signal.

11. A corona charger according to claim 9, wherein the voltage potential supply provides one of a first voltage and a second voltage, the first voltage in the range of about 5 to 11 kva and the second voltage in the range of about 13,000 to 22,000 volts peak-to-peak, and wherein the power supply provides a voltage in the range of about 300 volts to 900 volts.

12. A corona charger according to claim 9, wherein the charger cleaning apparatus has a pad to pass between the at least one corona wire and the grid.

13. A corona charger according to claim 9, wherein the at least one corona wire comprises three corona wires.

14. A method for activating charger cleaning in a corona charger for an image-forming machine, comprising the steps of:

(a) monitoring the corona charger for arcing;

(b) when arcing occurs, cycling the image-forming machine into standby mode;

(c) cleaning the corona charger; and (d) returning the machine to normal operation.

15. A method for activating charger cleaning according to claim 14, wherein step (a) further comprises detecting a voltage signal from a voltage detection circuit connected to at least one of a corona wire and a grid.

16. A method for activating charger cleaning according to claim 14, wherein step (c) further comprises passing a pad between at least one of a corona wire and a grid.

17. A method for activating charger cleaning according to claim 14, wherein step (c) further comprises the substeps of:

(c1) identifying a faulty image frame;

(c2) disposing of an image print generated by the faulty image frame;

(c3) cycling the image-forming machine to the faulty image frame, wherein the image-forming machine returns to normal operation in Step (d) at the faulty image frame.

18. A method for activating charger cleaning according to claim 17, wherein the substep (c2) further comprises disposing the image print into a disposal bin on the image-forming machine.

19. A method for activating charger cleaning according to claim 17, wherein the substep (c2) further comprises alerting an operator to remove the image print.

20. A method for activating charger cleaning according to claim 17, wherein the substep (c2) further comprises disposing of at least one print following the image print.

* * * * *